US006872876B2

(12) United States Patent
Ahrens

(10) Patent No.: US 6,872,876 B2
(45) Date of Patent: Mar. 29, 2005

(54) OCARINAS WITH AN INNER LINER AND AN OUTER SHELL

(75) Inventor: Karl P. Ahrens, Bloomfield, CT (US)

(73) Assignee: Mountain Ocarinas Inc., Bloomfield, CT (US)

( * ) Notice: Subject to any disclaimer, the term of this patent is extended or adjusted under 35 U.S.C. 154(b) by 52 days.

(21) Appl. No.: 10/413,950

(22) Filed: Apr. 15, 2003

(65) Prior Publication Data

US 2003/0192421 A1 Oct. 16, 2003

Related U.S. Application Data

(60) Provisional application No. 60/372,486, filed on Apr. 15, 2002.

(51) Int. Cl.[7] ..... G10D 7/00

(52) U.S. Cl. ..... 84/380 R; 84/382; 84/384; 84/386; 84/402

(58) Field of Search ..... 84/380 R, 382, 84/384, 386, 402

(56) References Cited

U.S. PATENT DOCUMENTS

| | | | | |
|---|---|---|---|---|
| 968,694 A | | 8/1910 | Rubright | |
| 2,145,605 A | | 1/1939 | Mausolf | 84/380 |
| 3,815,466 A | | 6/1974 | Johnson | 84/380 |
| 3,835,748 A | * | 9/1974 | Olson | 84/388 |
| 4,893,541 A | | 1/1990 | Fowler et al. | 84/380 |
| 6,348,647 B1 | | 2/2002 | Ahrens | |

OTHER PUBLICATIONS http://www.ne.jp/asahi/suimin/japan/doublet_e.htm.

* cited by examiner

*Primary Examiner*—Shih-Yung Hsieh
(74) *Attorney, Agent, or Firm*—McCormick Paulding & Huber LLP

(57) ABSTRACT

One embodiment of an ocarina has an inner liner that includes a plurality of apertures and an outer shell disposed substantially completely around the inner liner. In one exemplary embodiment of such an ocarina, the plurality of apertures in the inner liner facilitates the airflow communication through the inner liner to produce a tone when the ocarina is played, whereas the outer shell provides a protective or ornamental envelope for the inner liner and includes a plurality of openings that register with the apertures in the inner liner. In another exemplary embodiment, an ocarina has a body having a plurality of apertures disposed therein. The body is formed by an inner liner defined by at least one sound chamber and a first cooperating cover and an outer shell disposed substantially completely around the inner liner. The outer shell is defined by a vessel and a second cooperating cover, and some of the inner surfaces of the outer shell engage some of the outer surfaces of the inner liner to retain the inner liner in the outer shell in an interference fit.

9 Claims, 2 Drawing Sheets

OCARINAS WITH AN INNER LINER AND AN OUTER SHELL

CROSS REFERENCE TO RELATED PATENT APPLICATION

The present application claims the benefits of U.S. Provisional Patent Application Ser. No. 60/372,486, filed Apr. 15, 2002, entitled Ocarinas With an Inner Liner and an Outer Shell, which is incorporated herein by reference in its entirety.

FIELD OF THE PRESENT INVENTION

The present invention relates generally to musical wind instruments, and is more specifically directed to ocarinas having a protective inner liner disposed within an attractive outer shell.

BACKGROUND OF THE PRESENT INVENTION

A flute is a type of wind instrument in which the impingement of air on an edge as the air passes into a sound chamber causes the air to oscillate to produce an audible tone. One type of flute is a whistle flute or fipple flute, which employs a whistle-type mouthpiece and is among the most ancient of all musical instruments. In this family are the recorder (also known as the fipple flute or English flute), the flageolet, and the ocarina (also known as the globular flute or the vessel flute). The ocarina dates back to antiquity and is reported to be of South American or Central American descent, though there are indications of its use in other parts of the ancient world.

Most types of wind instruments employ an open-ended tubular- or conical-shaped cavity to produce sound, whereas ocarinas utilize an enclosed sound chamber or cavity. Ocarinas have at least one airway that directs an airstream across a fipple window to impinge upon a fipple edge, at least one sound chamber, and a plurality of toneholes that penetrate into the enclosed chamber and that are used to control the pitch sounded by the instrument.

Ocarinas may be fabricated from a variety of materials, such as ceramics, wood, metal, plastics, and the like. Many ocarinas sold commercially are not manufactured to the strict dimensional tolerances necessary to consistently produce acoustically excellent instruments. Nevertheless, major challenges are faced by manufacturers who do attempt to craft concert-worthy ocarinas from wood, metal, or other quality machinable materials. The tremendously precise and detailed handwork needed to produce musically superior ocarinas out of these materials requires skilled artisans and is very time consuming. Such a process is costly to both the manufacturer and consumer.

Other challenges encountered in the manufacture of quality ocarinas are related to excessive moisture. First, ocarinas made entirely of wood, while attractive in appearance, are subject to mold, mildew, swelling, shrinking, cracking, and to fluctuations in the vital tolerances of the airway. The above problems result primarily from moisture in the ocarina player's breath, which is blown through the airway and into the sound chamber. Second, ocarinas made entirely out of certain dense, hard machinable materials such as stainless steel, aluminum, or brass suffer from a different problem related to excessive moisture. Because of the high thermal conductivity of these materials, excessive condensation is quick to form in the ocarina airway as the ocarina player blows humid air through it. This build up of condensation causes the fading of notes, especially the notes at the higher end of the octave.

In the case of quality ocarinas molded entirely of some type of plastic resin, there are esthetic design challenges that stem from practical limitations as to how thickly a particular resin can be molded without the occurrence of sagging and shrinking.

SUMMARY OF THE PRESENT INVENTION

The present invention is directed to an ocarina having an inner liner that includes a plurality of apertures and an outer shell disposed substantially completely around the inner liner. In one exemplary embodiment of such an ocarina, the inner liner protects the ocarina shell from the adverse effects of moisture while the plurality of apertures in the inner liner facilitates the airflow communication through the inner liner to produce a tone when the ocarina is played by a musician. The outer shell provides a protective or ornamental envelope for the inner liner and includes a plurality of openings that register with the apertures in the inner liner. Preferably, at least some of the outer surfaces of the inner liner engage the inner surfaces of the outer shell in an interference fit to facilitate the retaining of the inner liner in the outer shell.

In another exemplary embodiment, an ocarina has a body having a plurality of apertures disposed therein. The body is formed by an inner liner defined by at least one sound chamber and a first cooperating cover and an outer shell disposed substantially completely around the inner liner. The outer shell is defined by a vessel and a second cooperating cover, and the inner surfaces of the outer shell engage the outer surfaces of the inner liner to retain the inner liner in the outer shell in an interference fit. The apertures are configured to facilitate the airflow communication through the body.

In any embodiment, the inner liners are manufactured with airways, fipple edges, sound chambers, and toneholes so that they can function as ocarinas before they are encased in outer shells. The advantages of this inner liner/outer shell design are several. First, the inner liners, which are preferably formed of an easily-manufactured, water resistant, relatively poor heat conducting material, serve to protect wood- or metal-shelled ocarinas (or ocarinas fabricated of similar materials) from the adverse effects of moisture. Second, the liners help to prevent excessive condensation in the airways of ocarinas clad with metal or with other materials that are highly heat conductive. Third, the inner liner/outer shell design greatly facilitates the manufacture of, ocarinas out of materials that enjoy high status such as wood, metal, and the like. Because precise airways, fipple edge assemblies, sound chambers, and toneholes can be mass produced in the molding of the inner liner, precision wood- or metal ocarinas can be produced by less skilled laborers in a fraction of the time that it would take skilled artisans to manufacture the instruments entirely out of wood, metal, or similar high status materials. Fourth, the inner liner/outer shell design facilitates the production of ocarinas in novelty shapes. For example, the same precise, easily-produced inner liners could be placed in a variety of outer shells configured to resemble animals, fish, or any other desirable shape. Finally, this design can improve the appearance of plastic-shelled ocarinas both by improving their contours and by providing offsetting color schemes because portions of the inner liner are visible in the assembled instrument.

DETAILED DESCRIPTION OF THE PREFERRED EMBODIMENT

Figure 1:
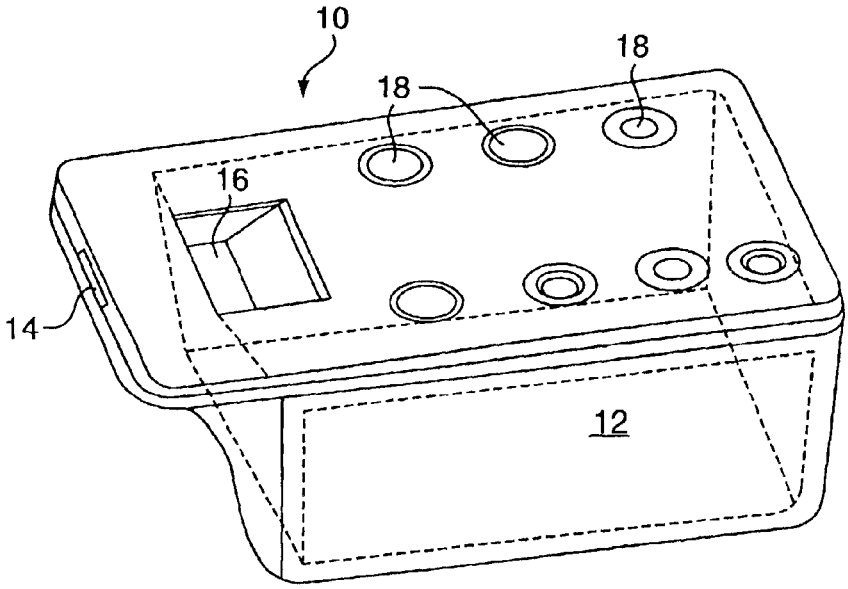
FIG. 1 is a perspective view of the preferred embodiment of the invention, an ocarina.

Referring to FIG. 1, an ocarina is shown generally at 10. The ocarina 10 includes an instrument body 12 perforated with a plurality of apertures. The apertures facilitate airflow communication through at least one inner chamber defined by the instrument body 12 and include an airway 14 through which air is blown into the ocarina 10, a fipple window 16 from which at least a portion of the received air is expelled, and a plurality of toneholes 18. Air is propelled through the airway 14 and impinges on a fipple edge, causing the air in the sound chamber 12 to oscillate, which produces sound waves having a frequency and an amplitude. When the toneholes 18 are selectively obstructed during the forcing of air through the airway 14, the frequency and amplitude at which the air in the sound chamber oscillates is varied, thereby producing tones of varying pitches. The obstruction of the toneholes 18 is effected by a person placing their fingers over the toneholes 18 to fully or partially close the openings. Generally, uncovering more toneholes causes the air in the sound chamber to oscillate more rapidly, which raises the pitch of the note sounded by the ocarina.

Figure 2:
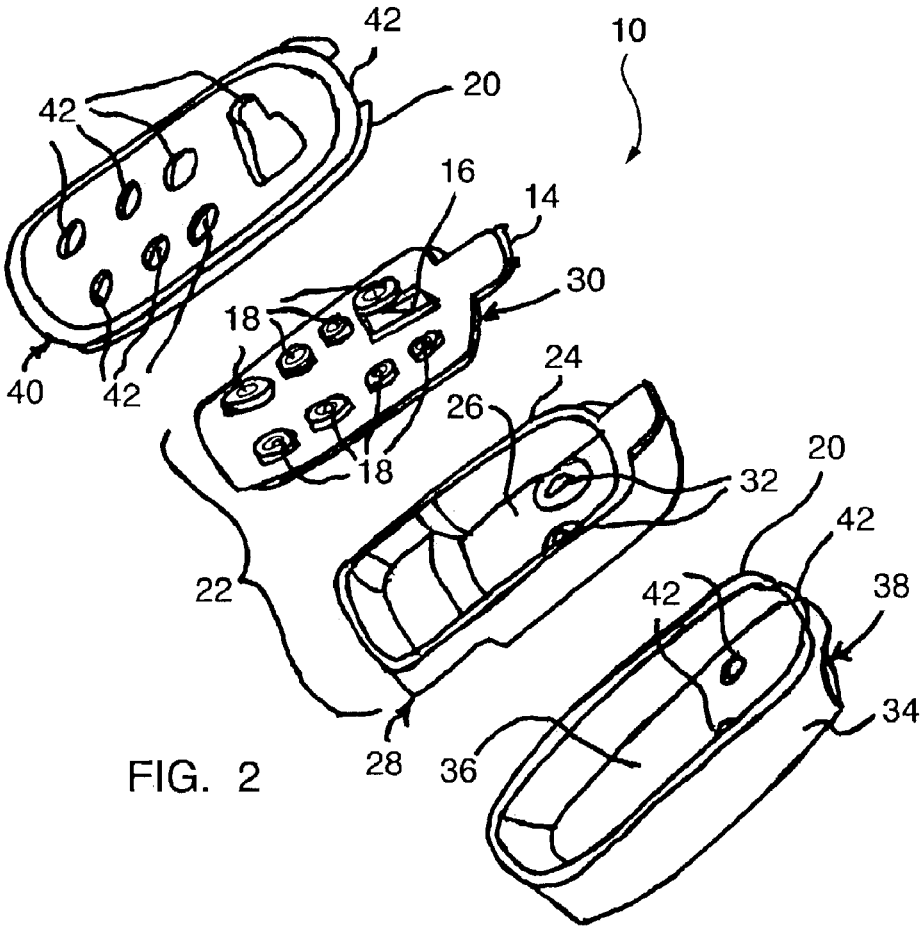
FIG. 2 is an exploded perspective view of an ocarina having an inner liner and an outer shell.

Referring now to FIG. 2, the instrument body of the ocarina 10 comprises an outer shell 20 disposed substantially completely around an inner liner 22, preferably in an interference fit. The term "substantially completely around" is intended to indicate the enclosing of the inner liner except at the holes through which air is introduced to or expelled from the instrument body. The inner liner 22 comprises at least one wall 24 that cooperates with an adjacent surface 26 to define at least one sound chamber 28. The inner liner 22 further comprises a cover 30 that cooperates with the wall 24 to close the chamber 28. The forcing of air across the fipple edge and into the closed chamber 28 and through the fipple window 16 produces a tone. Both the chamber 28 and the cover 30 are fabricated from any material that is sufficiently stable, durable, water resistant, and of relatively poor heat conductivity. Materials from which the chamber 28 and the cover 30 may be fabricated include, but are not limited to, thermoplastic polymers, thermosettable polymers, combinations of the foregoing polymers, and the like. When assembled, the inner liner 22 is of sufficient structural integrity to define a functioning ocarina.

Figure 3:
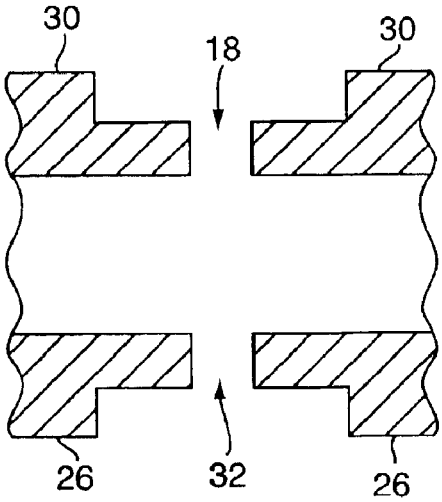
FIG. 3 is a cross-sectional representation of the toneholes of an ocarina.

The toneholes 18 are preferably molded into the cover but may be drilled, bored, or otherwise formed in the cover 30. Generally, two rows of toneholes 18 are disposed in the cover 30, the toneholes 18 of each row being disposed to allow sufficient space between the various toneholes to accommodate a musician's fingers. The diameters and depths of the various toneholes 18, rather than their precise location, determine the resulting pitch. A plurality of toneholes 32 may also be disposed at the surface 26 adjacent to the wall 24, such toneholes 32 being selectively obstructable by the thumbs of the person playing the ocarina 10. The smaller toneholes 18 disposed in the cover 30 or the smaller toneholes 32 disposed in the surface 26 may be counterbored, as is shown in FIG. 3, to allow the person playing the ocarina to more easily locate the toneholes 18 or the toneholes 32.

Referring back to FIG. 2, the outer shell 20 comprises at least one wall 34 and a cooperating adjacent surface 36 arranged to form a vessel 38 that receives the inner liner 22. A cover 40 is cooperative with the wall 34 to retain the inner liner 22 in the vessel 38. Preferably, the inner surfaces of the outer shell 20 engage the outer surfaces of the inner liner 22 to retain the inner liner 22 in the outer shell 20 in an interference fit, but some space can exist between some of the inner surfaces of the outer shell and the outer surfaces of the inner liner. Both the outer shell vessel 38 and the outer shell cover 40 include a plurality of openings 42 that register with the toneholes 18, 32, the airway 14, and the fipple window 16. The vessel 38 and the cover 40 are furthermore fabricated from a material that is conducive to being configured into the desired shape. The outward appearance of the outer shell 20, while generally not affecting the sound performance of the ocarina, may provide an overall rigidity to the ocarina 10, thereby resulting in a more solid, resonant sound. Materials from which the outer shell 20 may be fabricated include, but are not limited to, machinable materials such as woods and metals, stampable materials such as stainless steel and other sheet metals, castable materials such as aluminum or zinc alloys, and moldable materials such as polymers, plastics, clays, and the like.

Figure 4:
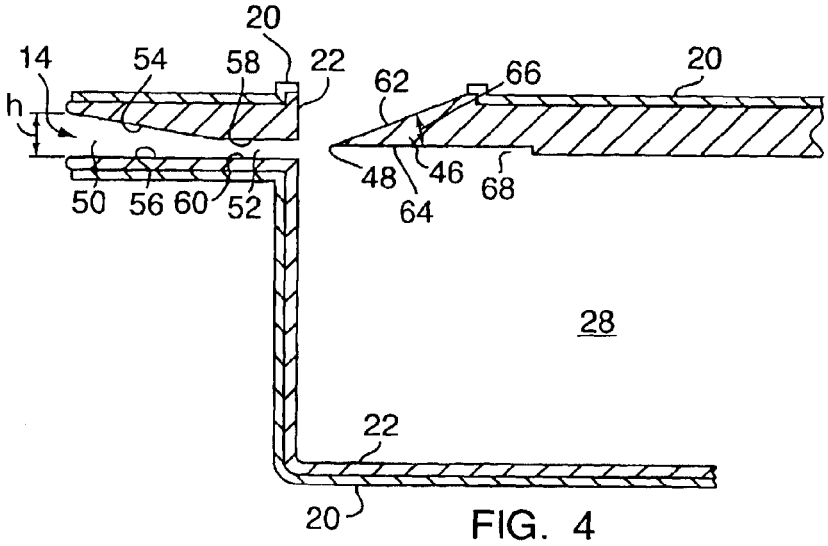
FIG. 4 is a cross-sectional representation showing the airway/fipple edge arrangement formed in an inner liner of an ocarina.

As is shown in FIG. 4, the airway 14 is configured to direct an airstream across the fipple window onto a fipple edge 48. The airway 14 is integrally attached to the inner liner 22 and is positioned relative to the rows of toneholes such that ocarina players may direct the airstream (e.g., by blowing) into the airway 14 while selectively covering and uncovering the toneholes with their fingers. The term "integrally attached to" is intended to indicate that the airway 14 and the inner liner 22 are formed such that the structural features of the airway 14 are contiguous with the adjacent surfaces of the inner liner 22. The airway 14 includes a nozzle section 50 as well as a throat section 52 through which the flow of the airstream may be directed at the fipple edge and into the sound chamber 28. The nozzle section 50 includes an upper surface 54 and a lower surface 56, at least one of which is inclined relative to the other to define a height h that progressively decreases toward the throat section 52. Additionally, the throat section 52 defines an upper surface 58 and a lower surface 60 that are substantially parallel to each other. The throat section 52 ensures that the airstream is properly aligned with the fipple edge 48 and reduces the turbulence of the air exiting the airway 14. The edges at the exit of the throat section 52 may be slightly radiused to further reduce the turbulence of the air exiting the airway 14. The upper surface 54 and lower surface 56 of the nozzle section 50, as well as the upper surface 58 and lower surface 60 of the throat section 52, are preferably accurately formed, shaped, and smoothed to provide the proper tone to the ocarina.

The fipple window is integrally formed with the inner liner 22. The term "integrally formed" is intended to indicate that the fipple window and its attendant structural features (e.g., the lip 46) are contiguous with the adjacent surfaces of the inner liner 22. The lip 46 comprises an upper surface 62 and a lower surface 64, which are both oriented with respect to each other to define an acute angle 66 to define the fipple edge 48. The lower surface 64 lies in a plane that is slightly elevated above a ceiling of the sound chamber 28 defined by the inner liner 22 (enclosed by the outer shell 20) so as to define an offset cavity 68. The offset cavity 68 is positioned so as to align the fipple edge 48 with the center of the airstream exiting the throat section 52, thereby bifurcating the airstream.

After the airstream is propelled through the airway 14, the airstream impinges upon and is bisected by the fipple edge 48 such that one portion of the airstream is directed out of the ocarina and another portion is directed into the sound chamber 28. The bifurcation of the airstream causes the cycling of different pressures at both sides of the fipple edge 48, which in turn causes the air to oscillate resulting in the formation of sound waves that resonate out of the sound chamber 28. The selective covering or uncovering of toneholes varies the frequencies of the sound waves produced. Moisture that enters the airway and the sound chamber 28 (e.g., through the moisture-laden breath of the ocarina player) does not adversely affect the instrument because of the protective inner liner 22.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. An ocarina, comprising:

a body, comprising an inner liner defined by at least one chamber and a cooperating cover, and an outer shell disposed substantially completely around said inner liner, said outer shell being defined by a vessel and a cooperating cover, an inner surface of said outer shell engaging an outer surface of said inner liner to retain said inner liner in said outer shell in an interference fit, and a plurality of apertures disposed within said body, said apertures being configured to facilitate airflow communication through said body.

2. The ocarina of claim 1, wherein said plurality of apertures comprises an airway through which a person may direct an airstream.

3. The ocarina of claim 2, wherein said airway is integrally formed with said inner liner.

4. The ocarina of claim 2, wherein said airway includes a nozzle section and a throat section.

5. The ocarina of claim 1, wherein said plurality of apertures comprises a fipple window through which a portion of an airstream directed into said chamber may be expelled.

6. The ocarina of claim 5, wherein said fipple window comprises a lip having a fipple edge, said fipple window being integrally formed with said inner liner.

7. The ocarina of claim 1, wherein said plurality of apertures comprises a tonehole that may be selectively obstructed by a person playing said ocarina.

8. The ocarina of claim 1, wherein said inner liner is fabricated from a thermoplastic polymer, a thermosettable polymer, or a combination of the foregoing polymers.

9. The ocarina of claim 1, wherein said outer shell is fabricated from a wood, a metal, an alloy, a polymer, a clay, or a combination of the foregoing materials.

* * * * *